United States Patent [19]

Lardellier

[11] Patent Number: 4,696,619

[45] Date of Patent: Sep. 29, 1987

[54] HOUSING FOR A TURBOJET ENGINE COMPRESSOR

[75] Inventor: Alain M. J. Lardellier, Melun, France

[73] Assignee: Societe Nationale d'Etude et de Construction de Moteurs d'Aviation "S.N.E.C.M.A.", Paris, France

[21] Appl. No.: 829,019

[22] Filed: Feb. 13, 1986

[30] Foreign Application Priority Data

Feb. 23, 1985 [FR] France ..... 85 02023

[51] Int. Cl.[4] ..... F01D 25/26

[52] U.S. Cl. ..... 415/138; 415/171; 60/39.32

[58] Field of Search ..... 415/115, 116, 134, 135, 415/136, 139, 137, 138, 171, 174, 175, 177, 178; 60/39.32, 39.75

[56] References Cited

U.S. PATENT DOCUMENTS

| | | | |
|---|---|---|---|
| 1,067,356 | 7/1913 | Ljungstrom | 415/136 |
| 4,065,077 | 12/1977 | Brooks | 60/39.31 X |
| 4,131,388 | 12/1978 | Brodell | 415/138 |
| 4,274,805 | 6/1981 | Holmes | 415/138 |
| 4,485,620 | 12/1984 | Koenig et al. | 415/136 X |
| 4,502,276 | 3/1985 | Pask | 415/138 X |

FOREIGN PATENT DOCUMENTS

| | | | |
|---|---|---|---|
| 0132182 | 1/1985 | European Pat. Off. . | |
| 2167837 | 8/1973 | France . | |
| 2422026 | 11/1979 | France . | |
| 2482661 | 11/1981 | France . | |
| 2535795 | 5/1984 | France . | |
| 679916 | 9/1952 | United Kingdom | 415/139 |

*Primary Examiner*—Robert E. Garrett
*Assistant Examiner*—Joseph M. Pitko
*Attorney, Agent, or Firm*—Bacon and Thomas

[57] ABSTRACT

A housing for a turbojet engine compressor is disclosed having inner and outer housing portions which may radially expand or contract as the compressor rotor wheel blades expand or contract, so as to maintain a minimum clearance between the housing and the rotor blade tips. A heat transfer manifold is applied about the outer periphery of the outer housing portion to rapidly expand the housing during transient operating conditions of the engine.

10 Claims, 2 Drawing Figures

HOUSING FOR A TURBOJET ENGINE COMPRESSOR

FIELD OF THE INVENTION

The instant invention relates to a housing for a turbojet engine compressor wherein the housing has means to accommodate radial expansion or contraction of the rotor blade wheel enclosed by the housing.

BRIEF DESCRIPTION OF THE PRIOR ART

Modern turbojet engines typically have multi-stage compressors wherein a plurality of rotor blade wheels are utilized, in conjuntion with interleaved stator vanes to compress the air from the intake of the engine. Such compressors have high compression ratios which may cause the intake gas temperatures at the latter stages to approach 600°-700° C.

The high temperatures and relatively high rotational speeds of the rotor blades wheels cause radial expansion of the rotor blade tips during operation of the engine. The clearance between the tips of the rotor blades and the surrounding housing should be maintained at a minimal distance to minimize gas leakage around the rotor blades, which would diminish the operating efficiency of the engine.

It is known to provide an abradable friction band on the inner surface of the housing which is subsequently abraded by the rotor blade tips during their operation. Although such abradable surfaces have proven acceptable, the radial expansion of the turbine blades abrades the surface, such that, when the operational conditions are such that the radial dimension of the rotor blade tips diminishes, an unnecessarily large clearance exists between the rotor blades and the housing.

Typically, the rotor blades, as well as the rotor wheel itself are made of a high-temperature resistant material which has a relatively low coefficient of thermal expansion. The stator vanes, however, are attached to the inner surface of the surrounding housing, which is usually made of steel or other metal having a relatively high coefficient of thermal expansion. The difference in expansion rates between the rotor blade tips and the surrounding housing has thus far rendered it extremely difficult to maintain a minimal clearance between these elements.

French Pat. No. 2,535,795 discloses a system for maintaining the rotor blade-housing clearance by fabricating the compressor housing from an inner and outer shell. The inner shell comprises a set of cylindrical segments having radial grooves in which the abradable surfaces or the stator vanes are mounted. The outer shell is cooled by a ventilating manifold supplied by incoming air taken from a stage of the compressor. The inner shell is allowed to expand and contract by its interconnection with the outer shell. Each of the segments are in the form of a parallelogram and include two upstream and two downstream shoes capable of receiving a fastening pin such that alternate fastening pins pass through the shoes of two consecutive segments.

French Pat. No. 2,482,661 describes another housing fabricated from an inner and outer shell wherein the inner shell comprises segments bearing the stator vanes and the abradable surfaces forming the seal. The inner segments are connected to the outer shell via rigid radial straps. The outer shell is ventilated by air jets issuing from a manifold which surrounds the outer shell and which is supplied with air taken from a compressor stage.

While such systems have improved the operations of the compressors, especially under steady-state conditions, they suffer from the disadvantage of providing substantial leaks through the gaps between adjacent segments of the inner shell. These new leaks have substantially offset the increase in efficiency gained by controlling the clearance between the housing and the rotor blade tips.

SUMMARY OF THE INVENTION

The present invention defines a housing for a turbojet engine compressor which controls the clearance between the housing and the rotor blade tips, without the increase in gas flow leakage areas of the prior art.

The housing according to the invention comprises first and second semi-cylindrical inner housing portions joined together along a medial plane, each inner housing portion having upstream and downstream annular flanges, which are affixed to, and form a seal with, the inlet low pressure housing on the upstream side and the diffuser housing at the downstream side. An annular outer housing portion extends about the first and second inner housing portions and is connected thereto via a plurality of connecting links extending in a generally radial direction. Each of the links are pivotally attached to the outer housing portion and either the first or second inner housing portion.

DETAILED DESCRIPTION OF THE PREFERRED EMBODIMENT

Figure 1:
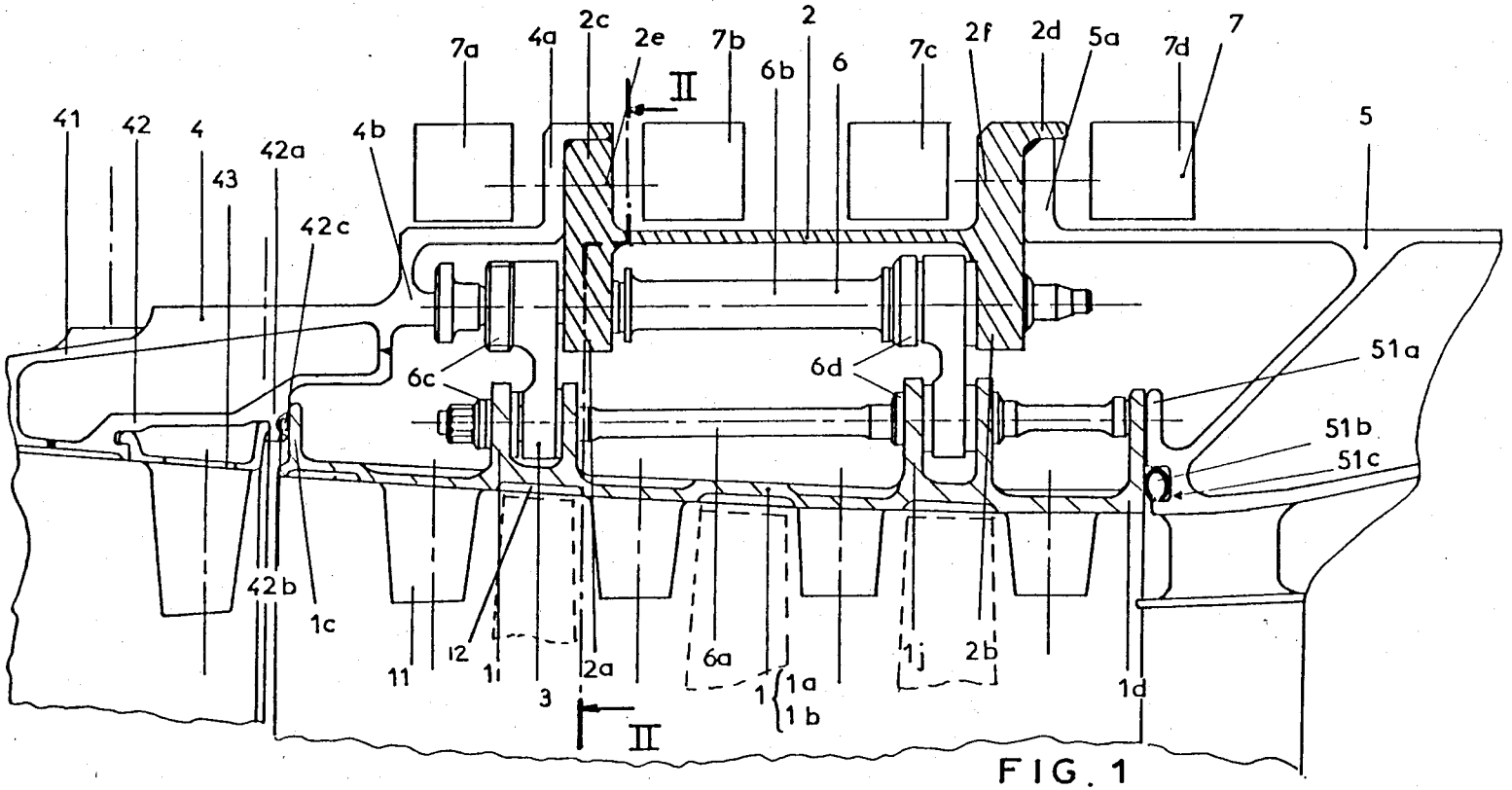
FIG. 1 is a partial, longitudinal sectional view of the compressor housing according to the invention.

In FIG. 1, a turbojet engine compressor is shown having four compression stages, the outer boundaries of the gas flow passage having a generally frusto-conical shape. Although a four stage compressor is shown, it is to be understood that this invention may be utilized with compressors having any number of compression stages.

The housing according to the invention comprises an inner housing portion 1, whose innermost surface defines the outer boundaries of the gas passage, and an annular outer housing portion 2. The inner housing portion 1 may be fabricated from two semi-cylindrical housing portions, 1*a* and 1*b*. These portions are joined together along a common plane containing the longitudinal axis of the engine. The innermost surfaces of inner housing portions 1*a* and 1*b* also contain bands 12 made of an abradable seal material of known configuration. This abradable material 12 is contacted by the tips of the rotor blades, shown in dotted lines in FIG. 1, to form a seal so as to prevent gas leakage around the tips of the rotor blades.

The inner housing portions each have radially extending flanges 1*c* and 1*d*, extending from their upstream and downstream portions, respectively. These flanges cooperate with flanges 42*a* on the low pressure housing 4 and 51*a* of the diffuser housing 5 as shown in FIG. 1. Flanges 42*a* and 51*a* define annular grooves 42*b* and 51*b*, in which seals 42*c* and 51*c* are located to prevent gas leakage at these junctures.

Figure 2:
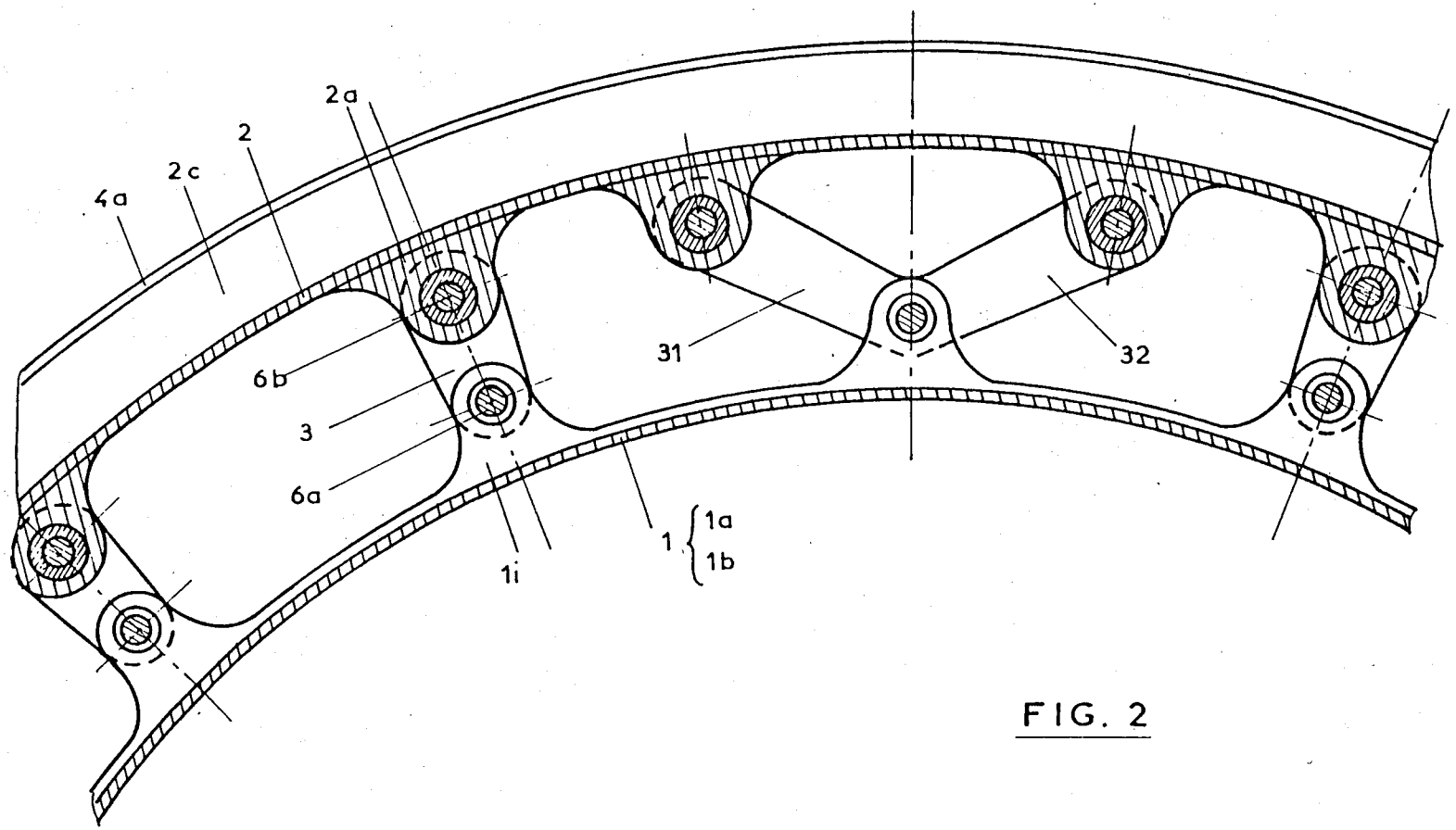
FIG. 2 is an enlarged, partial sectional view taken along II—II in FIG. 1.

The outer surface of inner housing portions 1*a* and 1*b* define an upstream array of yokes 1*i* and a downstream array of yokes 1*j* , each yoke defining a longitudinally extending opening therethrough. Attaching links 3, which extend generally in the radial direction, as shown in FIG. 2, have their first ends attached to the yokes 1*i* and 1*j* by hinge pin 6*a*. The yokes in the upstream array are longitudinally aligned with the yokes in the downstream array, such that a single hinge pin 6*a* may extend through corresponding yokes in each of the arrays. The 1*i* and 1*j* are regularly distributed about the periphery of the inner housing portions 1*a* and 1*b* Annular, outer housing portion 2 defines a plurality of mounting ears 2*a* and 2*b*, which extend radially inwardly therefrom. The mounting ears are also arranged in an upstream array 2*a* and a downstream 2*b*, and are regularly distributed about the inner periphery of the outer housing portion. The mounting ears 2*a* and 2*b* are located such that they are radially aligned with corresponding yokes 1*i* and 1*j*, respectively, as indicated in FIG. 2.

The second ends of attaching links 3 are pivotally attached to corresponding mounting ears 2*a* and 2*b* by hinge pin 6*b*. Hinge pin 6*b* extends through aligned openings in mounting ears 2*a* and 2*b* as well as through openings in the second ends of links 3. In order to accommodate for any misalignment of the openings in mounting ears 2*a* and 2*b*, or those through yokes 1*i* and 1*j*, sleeves 6*c* and 6*d* may be inserted therein. Sleeves 6*c* and 6*d* may have eccentric holes formed therethrough such that, by adjusting their relative angular positions, their holes can be axially aligned to facilitate the installation of hinge pins 6*a* and 6*b*.

Outer housing portion 2 has radially outwardly extending flanges 2*c* and 2*d* located at its upstream and downstream ends, respectively. These flanges define bores 2*e* and 2*f* which are aligned with corresponding openings in flanges 4*a* and 5*a* formed on the low pressure housing 4 and the diffuser 5, respectively. Bolts or other fasteners may be inserted through these openings to attach the outer housing portion 2 to these elements.

Low pressure housing 4 is comprised of an outer wall 41 and an inner wall 42. This housing also defines a flange 4*b* which bears against the upstream end of hinge pin 6*b* to prevent its axial movement in this direction. The inner wall 42 defines a plurality of openings 43 between the stator vanes. A portion of the gasses flowing through the compressor is withdrawn through these openings 43 and, by means which are well known in the art, may be supplied to annular heat transfer manifolds 7*a*, 7*b*, 7*c* and 7*d* which are formed about the outer periphery of the housing. These manifolds are in heat transfer relationship with the housing portions and, when heated gas is supplied to them, serve to transfer this heat to the outer housing portions.

Connecting bars 31 and 32 also serve to interconnect the annular outer housing 2 with the inner housing portions 1*a* and 1*b*. As shown in FIG. 2, each of these connecting bars has a first end pivotally connected to the outer housing portion 2, while the inner ends are pivotally attached to the inner housing portion 1*a* or 1*b* at a common point. This common attaching point lies approximately midway between the ends of the inner portions 1*a* to 1*b*. If it be assumed that the inner portions are attached together at the 3 o'clock and 9 o'clock positions, the common attaching points of connecting bars 31 and 32 would be at the 12 o'clock and 6 o'clock positions, respectively. Due to the converging orientation of the connecting bars 31 and 32, relative radial movement between the outer housing portion 2 and either the inner housing portion 1*a* or 1*b* is prohibited at these locations. This provides fixed points from which the peripheral expansions will begin. The expansion is permitted since the juncture of the inner housing portions 1*a* and 1*b* permits relative sliding between these elements, but otherwise defines a hermetic sealing surface.

Under steady-state operating conditions, the inner housing portion and the outer housing portion radially expand by equal amounts which may be controlled by their diameters and their respective coefficients of thermal expansion. Attaching links 3 may also expand by the same value. The radial expansion of the inner and outer housing portions, as well as that of the connecting links, is computed such that, in a steady-state, it equals the sum of the centrifugal and thermal expansions of the rotor blades and the rotor disks. The clearance between the ends of the rotor blade tips and the abradable sealing bands are thereby maintained at their optimal value without the need of applying heat to the outer shell 2 through the manifolds 7*a*–7*d*. Thus, under these conditions, the housing provides the requisite clearance without the need to withdraw any gas from the gas stream passing through the compressor.

The inner housing portion 1 radially expands due to the increase in temperature imparted through its direct contact with the gas stream, and also to the forces exerted on it by the outer housing 2 through the connecting links 3. Under equilibrium conditions, however, the radial expansion of the inner and outer housing portions 3 are substantially equal and, thus, there is very little tension in connecting links 3.

Under transient operating conditions, such as acceleration of the engine, gas at approximately 300° C. is withdrawn upstream of the high pressure compressor stage and is directed into the heat transfer manifold 7*a*–7*d*. Each of these manifolds may define openings through which the heated gas is directed onto substantially the entire outer periphery of outer housing portion 2. Due to this direct heating contact, the outer housing 2 expands more rapidly than the inner shell 1, but due to the rigid interconnection of links 3, causes the inner housing portions 1 to also expand.

Due to the attachment points between the outer housing portion and the inner housing portion at the 12 o'clock and 6 o'clock positions, the radial expansions of the inner housing portions 1*a* and 1*b* are not homogeneous. Although this heterogeneity may cause the sealing planes between the first and second inner housing portions to open slightly, and may cause the inner housing portion to deform from their semi-cylindrical shapes, such deformations are minute and the stresses applied to the housing are negligible.

When the engine undergoes deceleration, the manifolds 7*a*–7*d* are partially supplied with hot gas to prevent the inner and outer housing portions from immediately contracting radially inwardly. The resultant increase in the clearance between the rotor blade tips and the inner housing portion, as the rotor blade tips contract during deceleration, only negligibly affects the efficiency of the engine, while at the same time provides a safety margin against undesired contact between the rotor blade tips and the inner housing portion in the event of a sudden, subsequent acceleration of the engine.

The foregoing description is provided for illustrative purposes only and should not be construed as in any way limiting this invention, the scope of which is defined solely by the appended claims.

What is claimed is:

1. A housing for a turbojet engine compressor having at least one annular array of stator vanes and at least one rotor blade wheel rotating about a longitudinal axis of the engine, comprising:

(a) first and second semi-cylindrical inner housing portions joined together along a common plane containing the longitudinal axis of the engine, the inner portions having the stator vanes attached thereto and extending about the rotor blade wheel such that a clearance is defined between the inner portions and tips of the blades on the rotor blade wheel;

(b) an annular outer housing portion extending about the first and second inner housing portions and radially spaced therefrom;

(c) a plurality of links extending in a generally radial direction, each link having first and second ends;

(d) first attaching means to pivotally attach the first ends of the links to the inner housing portions; and, (e) second attaching means to pivotally attach the second ends of the links to the annular outer housing, such that thermal expansion or contraction of the inner and outer housing portions serves to maintain the clearance between the inner housing portions and the rotor blade tips throughout variations in operating parameters of the turbojet engine.

2. The turbojet engine housing according to claim 1 wherein the first attaching means comprises:

(a) a plurality of yokes extending radially outwardly from the first and second inner housing; and, (b) a hinge pin extending through the yoke and the first end of a link so as to pivotally attach the link to the yoke.

3. The turbojet engine housing according to claim 2 wherein the plurality of yokes are distributed about the inner housing portions in first and second annular array, the second annular array being spaced longitudinally from the first annular array, each yoke in the first array being longitudinally aligned with a yoke in the second array.

4. The turbojet engine housing according to claim 3 wherein a hinge pin extends through a yoke in the first array and the second array, such that a longitudinal axis of the pin is substantially parallel to the longitudinal axis of the engine.

5. The turbojet engine housing according to claim 2 wherein the second attaching means comprises:

(a) a plurality of mounting ears extending radially inwardly from the outer housing portion, each ear defining an opening therethrough; and, (b) a second hinge pin extending through the opening and the second end of the link so as to pivotally attach the second end of the link to the outer housing portion.

6. The turbojet engine housing according to claim 5 wherein the mounting ears are located in an upstream plane and a downstream plane spaced apart from the upstream plane, each mounting ear in the upstream plane being longitudinally aligned with a corresponding mounting ear in the downstream plane.

7. The turbojet engine housing according to claim 6 wherein a second hinge pin extends through a mounting ear in the upstream plane and the downstream plane, such that its longitudinal axis is substantially parallel to the longitudinal axis of the engine.

8. The turbojet engine housing according to claim 1 further comprising:

third attaching means extending between the annular outer housing portion and approximately the midpoint of the circumference of each of the first and second inner housing portions so as to prevent relative radial movement between the first and second inner housing portions and the annular outer housing portion in a direction substantially perpendicular to the common plane.

9. The turbojet engine housing according to claim 8 wherein the third attaching means comprises:

(a) first and second connecting bars having first ends pivotally attached to the outer housing portion and second ends pivotally attached to a common point on the first inner housing portion; and, (b) third and fourth connecting bars having first ends pivotally attached to the outer housing portion and second ends pivotally attached to a common point on the second inner housing portion.

10. The turbojet engine housing according to claim 1 further comprising:

(a) at least one annular manifold disposed about the outer annular housing portion, the manifold being in heat transfer relationship with the outer housing portion; and, (b) means to direct a flow of air from a stage of the compressor into the at least one annular manifold.

* * * * *

UNITED STATES PATENT AND TRADEMARK OFFICE

CERTIFICATE OF CORRECTION

PATENT NO. : 4,696,619

DATED : September 29, 1987

INVENTOR(S) : LARDELLIER

It is certified that error appears in the above—identified patent and that said Letters Patent is hereby corrected as shown below:

Col. 3, lines 10-11 "The li and lj" should be --The yokes li and lj--;

Col. 3, line 12 "lb Annular," should be --lb. Annular,--

Signed and Sealed this

Fifth Day of January, 1988

*Attest:*

DONALD J. QUIGG

*Attesting Officer*

*Commissioner of Patents and Trademarks*